United States Patent [19]

Johnson

[11] Patent Number: 4,815,640

[45] Date of Patent: Mar. 28, 1989

[54] UNDERARM UTILITY BAG

[76] Inventor: Rodney N. Johnson, 508 E. Skillman Ave., Maplewood, Minn. 55117

[21] Appl. No.: 73,006

[22] Filed: Jul. 13, 1987

[51] Int. Cl.[4] ..... A45F 3/02

[52] U.S. Cl. ..... 224/202; 224/258; 224/264; 224/907; 383/75; 383/907

[58] Field of Search ..... 224/202, 257, 907, 264, 224/191, 151, 226, 271, 272, 270, 258, 235, 241, 210, 214, 245, 246; 150/107, 127; 383/72, 75, 4, 907

[56] References Cited

U.S. PATENT DOCUMENTS

| | | | |
|---|---|---|---|
| 432,607 | 7/1890 | Dwyer | 224/236 X |
| 794,948 | 7/1905 | Rischard | 224/257 |
| 955,164 | 4/1910 | Husted | 224/191 |
| 1,281,822 | 10/1918 | Orr | 224/264 X |
| 2,617,569 | 11/1952 | Sommer | 383/75 X |
| 2,635,664 | 4/1953 | Cohen | 383/75 X |
| 2,697,465 | 12/1954 | Johnson | 383/4 |
| 2,897,863 | 8/1959 | Somers, Jr. | 383/103 X |
| 2,969,899 | 1/1961 | Brooks | 224/151 |
| 3,578,225 | 5/1971 | Schroeder | 224/202 |
| 4,303,187 | 12/1981 | Berman | 224/226 X |
| 4,687,036 | 8/1987 | Thomas | 224/236 X |

*Primary Examiner*—Henry J. Recla
*Assistant Examiner*—Linda J. Sholl
*Attorney, Agent, or Firm*—Douglas L. Tschida

[57] ABSTRACT

A tool or utility bag for confined spaces wherein a heavyweight fabric pouch includes a drawstring closure arranged relative to a V-shaped access opening. An adjustable length, padded shoulder strap mounted to the draw cord supports the bag away from the shoulder, while a formed hip stay supports the bag from the hip. In alternative embodiments, a weatherproof cover, full-height hip support plate, auxiliary pockets and/or V-opening strap closures are included.

10 Claims, 6 Drawing Sheets

UNDERARM UTILITY BAG

BACKGROUND OF THE INVENTION

The present invention relates to utility bags and, in particular, to a shoulder/hip supported utility bag including a self-closing draw top having a V-shaped access opening.

For the workman or repairman who, of necessity, works in limited or confined spaces, it oftentimes is difficult, without making a number of trips, to have a sufficient quantity of tools available to perform a given job. While a number of solid bodied tool boxes exist, the aforementioned space limitations more often than not prevent the workman from carrying the box to the work site, due to the necessity of keeping both hands free or the physical limitations of the access space. Examples of such areas are crawl spaces, tunnelways, catwalks or ladderways. Accordingly, a need exists for a utility or tool container which is easily transported by the workman, that does not take up significant amounts of space and allows hand-free carrying.

Of available tool carriers Applicant is aware of, most again are of a solid wall construction; although, Applicant is aware of a variety of belt-supported, leather-carrying pouches; cloth baskets which may be raised and lowered with a rope; as well as fabric bags for plastering and cement tools, where the porous bag allows for air drying. While each of the foregoing carriers has their place, where relatively bulky and/or a large number of tools are required, the rope/basket carrier probably offers the greatest advantage, although requires the presence of a helper to tend the opposite end of the rope.

With the foregoing limitations in mind, the present invention was developed to enable a worker to convey a relatively large number of relatively bulky tools within a conformable fabric sack and in a fashion to evenly distribute the weight, while protecting the workman during transport. The bag, although primarily designed as a transport device, also allows removal at the work site and enables access to its contents, when removal is difficult, as it is supported from the workman. Appreciating further the advantages of the present pouch, additional advantages are recognized in other applications and occupations for use by sportsmen, poultry farmers, orchard growers and the like.

SUMMARY OF THE INVENTION

It is accordingly a primary object of the present invention to provide for a shoulder-supported, fabric utility pouch.

It is another object of the invention to provide means for distributing the pouch weight relative to the wearer's hip, while also providing protection from the tools.

It is a further object of the invention to provide a self-closure system whereby the supported weight seals off the pouch top.

It is a still further object of the invention to provide ready access to the pouch contents while the primary access opening is closed.

It is still another object of the invention to provide for support strap adjustment, weather protection and a secure closure system.

These and other objects are achieved in the present fabric pouch which is constructed about a draw cord/-strap that removably mounts to a padded shoulder strap. While worn, the contained weight draws tight a portion of the opening, while exposing a V-shaped access opening. An integral hip stay and a kidney-shaped bottom facilitate support from the hip.

In various alternative embodiments, a weatherproof cover, auxiliary pocket, full-height hip stay and closures for the V-shaped access opening are disclosed. Additional modifications are also discussed relative to other functional applications for the bag.

The foregoing objects, advantages and distinctions of the invention, as well as a detailed description of its construction, will become more apparent upon reference of the following description with respect to the appended drawings. Before referring thereto, is to be appreciated the invention is described by way of its presently preferred embodiment only, which description is not intended to be all encompassing, nor should it be interpreted in limitation of the full scope of the invention. To the extent various alternative embodiments and/or modifications have been considered, they are described as appropriate.

DESCRIPTION OF THE PREFERRED EMBODIMENT

Figure 1:
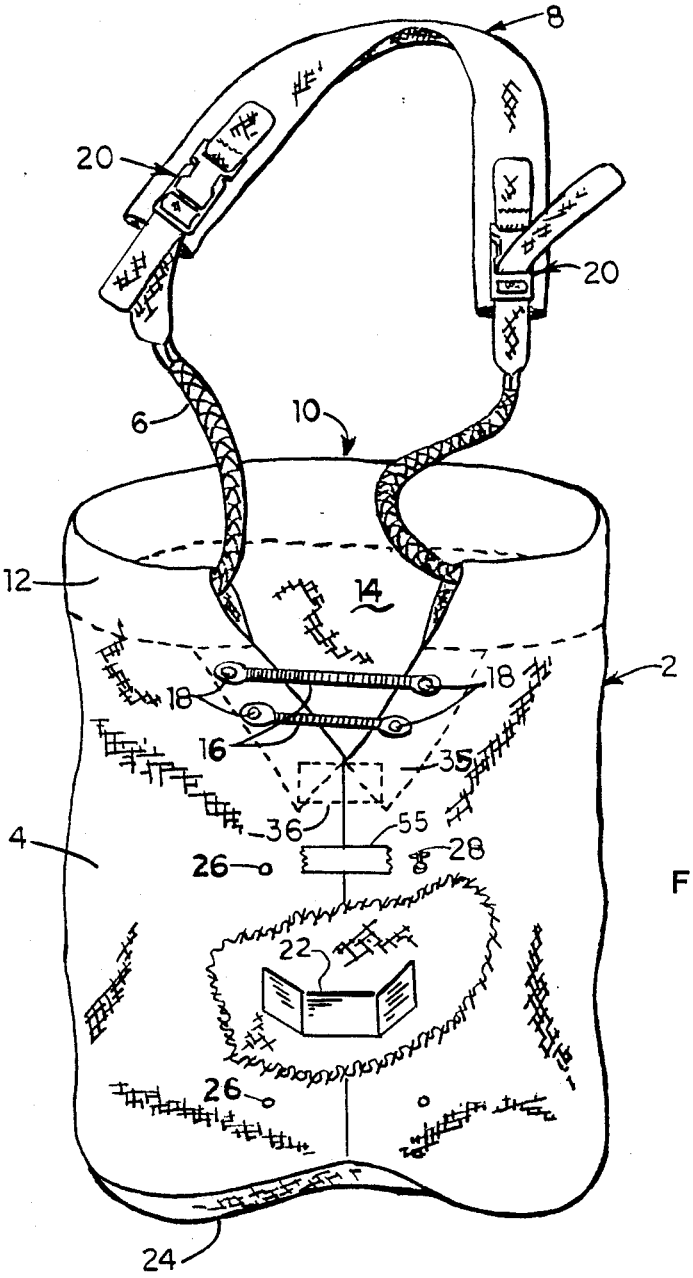
FIG. 1 shows a perspective view in partial cutaway of the present utility bag in its open condition.
Figure 2:
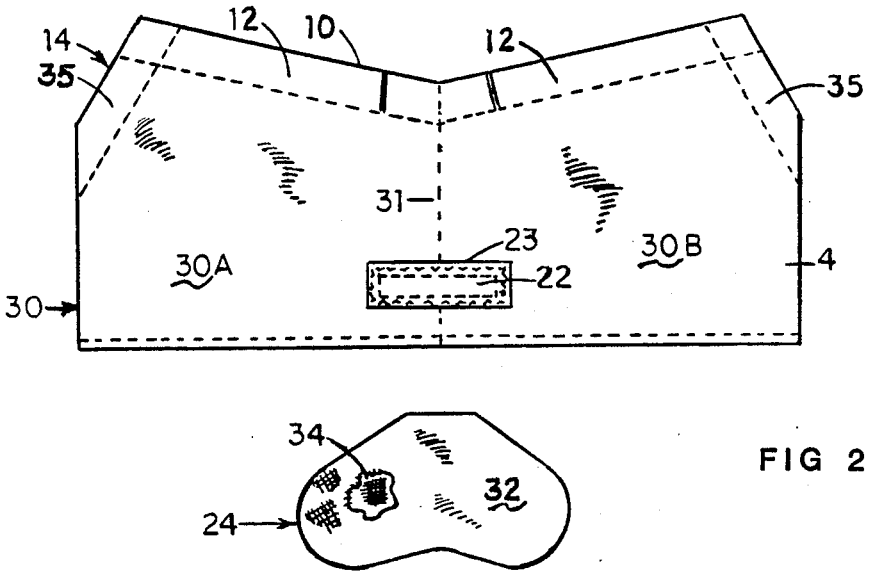
FIG. 2 shows a pattern view of the pouch.

Referring to FIG. 1, a perspective assembly view is shown of the invention in partial cutaway as it would appear in normal use. FIG. 2, in turn, shows a pattern view of the bag as it appears after being cut from a piece of fabric and prior to sewing. From FIG. 1, it is to be appreciated the bag 2 is comprised of a fabric pouch portion 4 which is supported from a rope or cord, draw closure member 6, the ends of which are sewn to a strap, removably secured to an adjustable length padded shoulder strap 8.

The top opening to the pouch 4 is constructed of two portions, the uppermost portion 10 of which is generally circular and is defined by a related hem 12 formed in the top of the pouch material. A lower, frontal V-shaped portion 14 opens to the circular portion 10, but when the portion 10 is drawn closed via the cords 6, a wearer may access the pouch contents by way of the V-shaped opening 14. In the presently preferred embodiment, the opening 14 is unobstructed, although as shown in FIG. 1, a pair of strap closures 16 and oppositely mounted mating fasteners 18 are provided to secure the opening 14 against spillage, yet not to the point where the wearer cannot access contained equipment.

Figure 7:
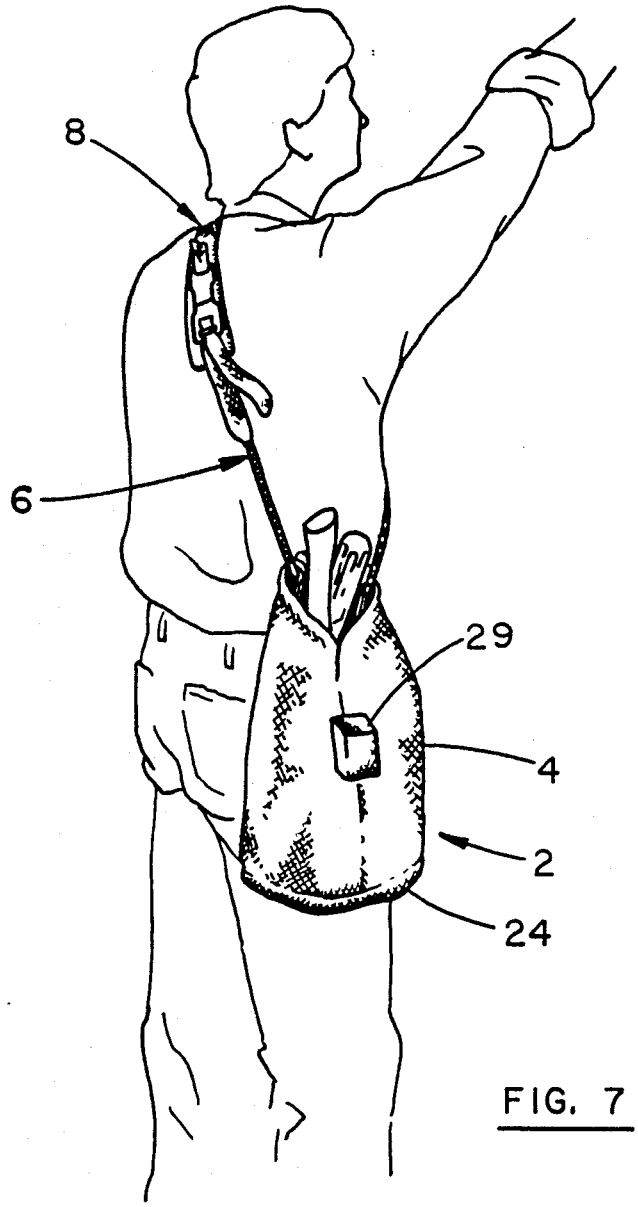
FIG. 7 shows the utility bag of FIG. 1 as it appears when worn.

With attention also directed to FIG. 7, the bag 2 mounts over the wearer's shoulder, most typically with the pouch 4 suspended adjacent the hip with the strap 8 suspended over the opposite shoulder. In this fashion, the cord 6, in addition to closing the opening 10, draws the closed opening toward the body, thus exposing the V-shaped access opening 14. Depending on the wearer's size, the length of shoulder strap 8 may be adjusted via a pair of end-mounted, two-part buckles 20.

With the bag 2 thus supported, it is suspended away from the wearer's hip via a U-shaped stay member 22 which is a fitted in a fabric sleeve 23 (see FIGS. 1, 2 and 6) sewn to the back of the bag. The stay member 22 thus rides against the wearer's hip to provide additional support and prevent the bag contents from unduly wrapping about the waist, hip and upper thigh of the wearer to the point where movement is obstructed or injury results.

Depending upon the bag contents, such as where sharp implements are carried, the stay member 22 can be constructed in a variety of sizes and shapes to provide additional support and/or protection from the bag contents. At present, the stay member is formed from a piece of 1/16 to 3/16 inch thick aluminum stock, approximately ¾ inches wide by 7 inches long, that is bent to shape. The stay 22 is mounted in a two-inch piece of sleeve 23 forming tubular webbing. For relatively larger and wider stay members, the material and sleeve 23 size may be varied, so long as the requisite support and protection are obtained and the weight of the stay does not become objectionable. Accordingly, in lieu of various malleable metals, varieties of plastic stay members can be used. Such larger stays might also be perforated to provide for ventilation.

In passing, it is to be noted the bottom 24 of the bag 2 is somewhat kidney-shaped to further accommodate the hip mounting, but which construction will become more apparent hereinafter with respect to FIG. 2. It is also to be noted the pouch 4 is presently constructed from 420-weight nylon fabric, while the bottom includes an additional layer of 1000-weight cordura 34 which is sewn to the nylon. Such fabric weights accommodate the relatively rugged use to which the bag is exposed without tearing. Heavier or multiple layers of fabric, as in the bottom 34, may be employed depending upon the application; just as the bottom 24 may be constructed to further include a correspondingly shaped plastic or fiberboard insert (not shown) between the layers.

Although the foregoing fabric has proven durable enough for the mentioned applications, with the weave being sufficiently dense, it may be preferable in some applications to provide vents 26, such as grommets within the pouch itself. These vents 26, in addition to ventilating the contents, may also be used as points for securing ropes or the like. One or more hook or snap fasteners 28 may also be included for separately attaching to a tool safety line, a roll of tape or other necessary paraphernalia.

In the latter regard, an auxillary external covered pocket 29 (see FIG. 3) is mounted to the outside of the bag. The pocket may be permanently or releasably secured to the pouch and it may include a cover or not. It is intended, though, to contain small or frequently accessed items.

In its use as a tool bag, the foregoing construction provides for a conformal storage pouch which is readily supported from the wearer without the aid of the hands. The bag also provides a relatively flat profile relative to the standing wearer which allows use of the bag in a variety of confined spaces, such as silo ladders, radio antennas, and other environments where the wearer must traverse a narrow vertical passageway or work erect.

Turning attention next to FIG. 2, a view is shown of the pattern cutting from which the bag 2 is assembled. Generally, the body of the pouch 4 is constructed from two pieces of fabric 30*a* and 30*b*, which are sewn together at a center seam 31. The bottom 24 is constructed from two identical kidney-shaped pieces 32 and 34 which are sewn to one another and to the combined pouch piece 30. In dimensional terms, the fabric pouch piece 30 is approximately 40 inches long and 18 inches wide which, when combined with the bottom 24, provides for a bag approximately 18 inches tall by 14 inches wide by 8 inches deep.

From FIG. 2, it is also to be appreciated the top edges of the pieces 30*a* and 30*b* are folded over at the dotted lines and hemmed to one another to form the draw cord 6 containing hems 12 and 35. The intersection of the hem 35 for the V-opening 14 as it overlaps the hem 12 of the circular opening 10 is sewn in one direction only so that the cord 6 may pass therethrough. This doubling of the material, in addition to forming the passage for the draw cord 6, reinforces this high-wear area. Double stitching may also be provided. Reinforcement tabs 36 may additionally be sewn to the fabric at the bottom of the V-opening 14, as shown in FIG. 1, and/or at the outlets of each of the draw cords 6 and/or along the entire length of the hem 12 and/or along the hem between the bottom 24 and pouch 4.

Figure 3:
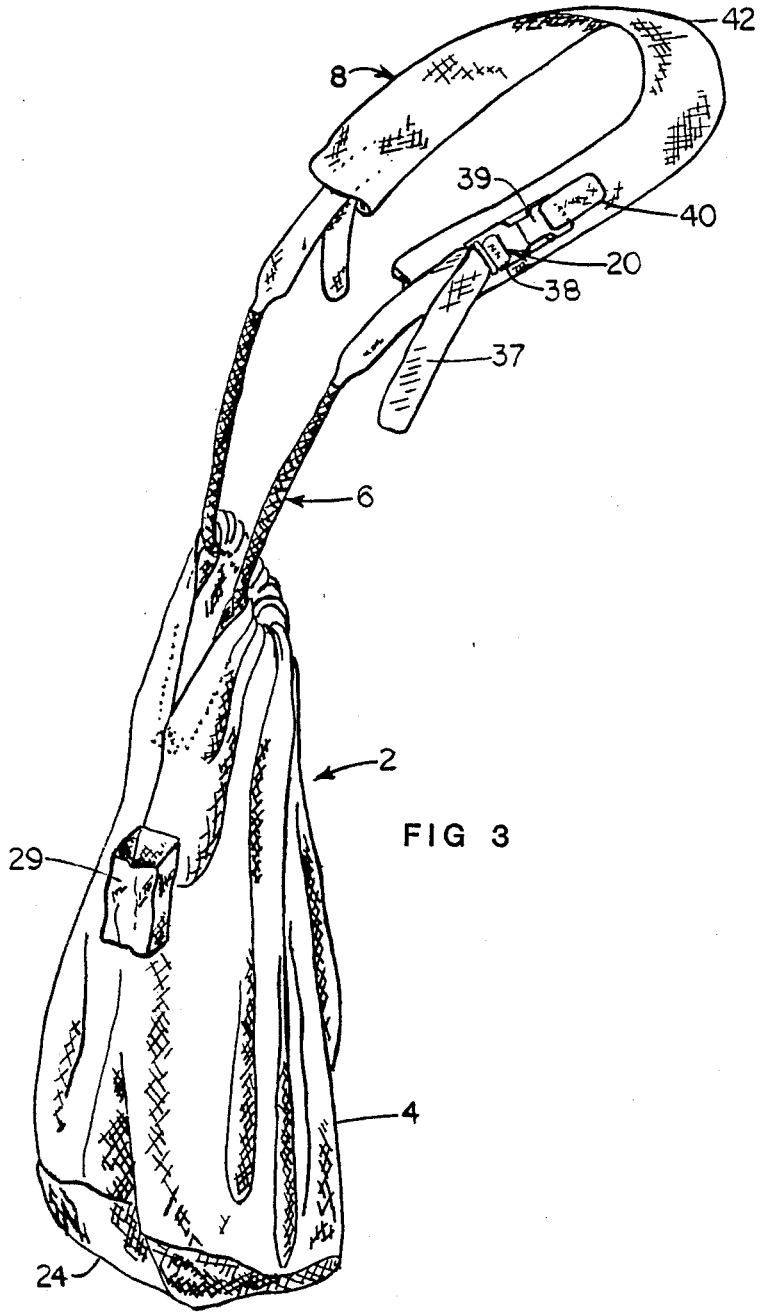
FIG. 3 shows a detailed perspective view of the bag in its closed condition and of the shoulder strap and draw closure arrangement of the invention in relative mounted relation to a wearer.

Directing attention next to FIG. 3, a detailed perspective view is shown of the draw closure construction and the mounting relation of the draw cord 6 and shoulder strap 8 thereto. Also better appreciated from this view is the construction and mounting relation of draw cord 6 to the shoulder strap 8. Specifically, it is to be appreciated that upon supporting the filled pouch 4 from the shoulder, the opening 10 compresses with the hem 12 drawing or pinching together along the cord 6. In the preferred embodiment, a 5.5 millimeter woven nylon cording material is used which facilitates slippage of the fabric on the cord.

The upper end of each cord, in turn, is sewn to the lower end of a strap member 37, which is rolled over the cording 6. The upper, flat end of the strap 37 is passed in length-adjustable relation to a lower releasable portion 38 of buckle member 20. The other end 39 of the buckle 20 is supported from a short fabric loop 40 which is sewn to a wider padded shoulder strap 42. The cord members 6 and straps 37 are thus not only length-adjustable relative to their mating buckle portion 38, but may also be removed from the shoulder strap 42. In lieu of a separate cord member 6, it is to be appreciated the strap 37 might be continuous and rolled over upon itself to form the cord member 6.

In the preferred embodiment, Fastex SRI snap fasteners are used for the buckles 20 and the padded shoulder strap 42 is constructed of a 2-inch tubular webbing which may be filled with padding and/or a larger pad may be slidably mounted thereto. Although similar strap mounting constructions are used for each end of the cord 6, it is to be appreciated the left most buckle 20 of FIG. 1 could be deleted, with the corresponding cord 6 being permanently secured to the shoulder strap 42. This arrangement would be acceptable for a range of wearers, although a two-buckle construction provides for maximum flexibility vis-a-vis the wearer's physical size, not to mention adjustment to the environment where the bag 2 is being used, which may require other than a hip mounting.

Figure 5:
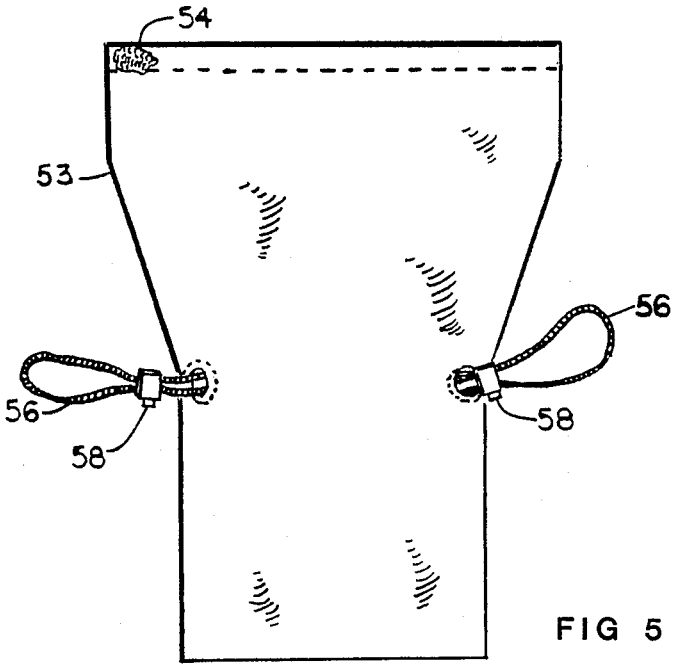
FIG. 5 shows an alternative waterproof cap.
Figure 4:
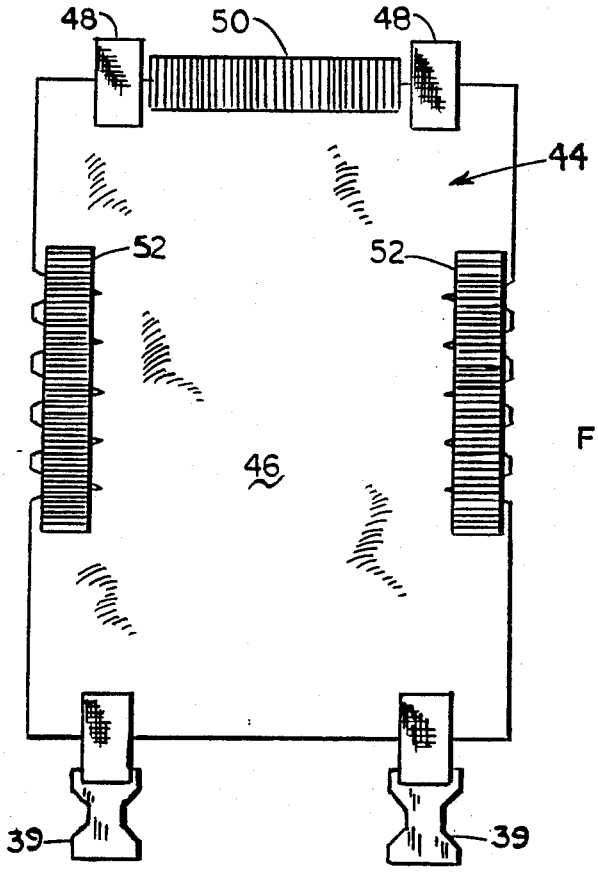
FIG. 4 shows a pattern view of a waterproof cap assembly.
Figure 6:
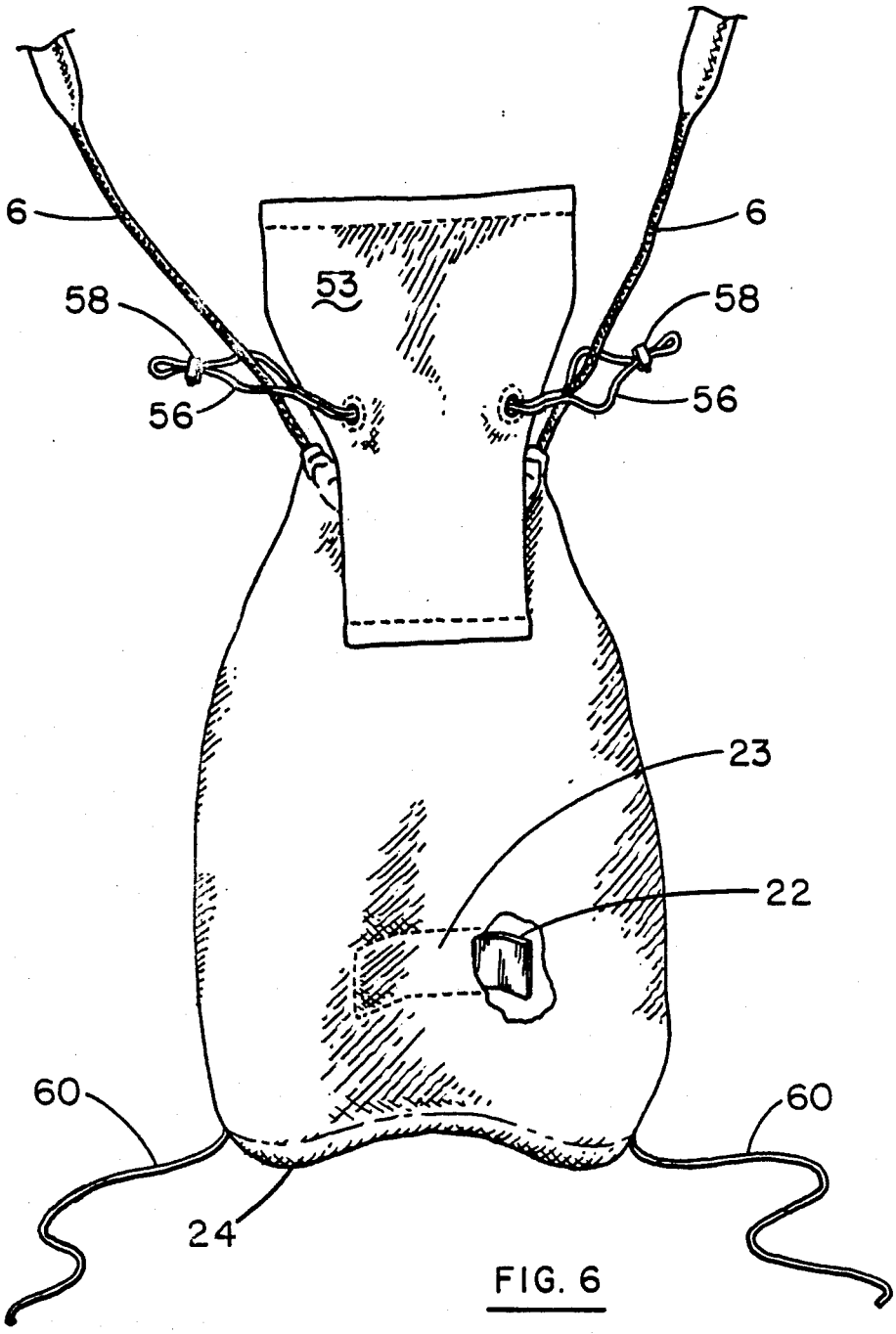
FIG. 6 shows the back side of the utility bag of FIG. 1.

Turning attention lastly to FIGS. 4, 5 and 6 FIG. 4 shows a waterproof cover 44 which may be added to the bag 2 for applications where quick access may not be required. For such instances, a generally rectangular flap member 46 is added to the pouch 4 by sewing and/or releasably securing one edge to the back of the pouch 4 and releasably securing an opposite edge and/or side edges to the front or both sides of the pouch by way of one or more of separately mounted buckles or fasteners. In the preferred embodiment, the back flap edge is sewn to the pouch with a pair of relatively stiff webbing members 48 and between which is sewn an intermediate elastic hinge 50 which, in combination, form a flexible and durable hinge mounting.

The side edges of the cover 42 are additionally cut or pleated in a zigzag fashion and elastic banding members 52 are secured to the edges of the cover to pull the cover 44 about the pouch. The opposite end of the cover, again, includes one or more buckles, such as the buckles 39; the mating portions of each of which are secured to the pouch 4 and to the cover by way of short loops of webbing 50. An elastic band member (not shown) may also be secured to the front cover edge, with or without pleating similar to that along the side edges, for further inducing the confirmation of the cover to the bag.

FIG. 5 shows an alternative cover 53 which is similarly secured to the back of pouch 4. A strip of Velcro TM fastener 54 secured to the front edge mates with a strip 55, a portion of which is shown in FIG. 1 relative to its typical mounting, sewn on the pouch to seal the front of the cover. Cord loops 56, in turn, mount about the cords 6 and spring-loaded draw cinches 58 allow the cover side edges to be pulled tight to the pouch when sealed. Otherwise, when the cinches 58 and fastener 54 are released, the V-opening 14 is exposed.

FIG. 6, in turn, shows the cover of FIG. 5 secured to the back of the pouch 4. Also more clearly depicted is the arcuate mounting obtained by way of the stay member 22 and the kidney shaped bottom 24.

Still other modifications Applicant has contemplated incorporating into the bag 2 are the forming of the V-shaped opening 14 more in a U-shape, such as for gathering fruits or vegetables or possibly in poultry applications, where it is necessary to remove dead birds from a hatchery or the like. Tie straps 60 (reference FIG. 6) might also be mounted adjacent the bag bottom for securing the lower bag end to the wearer's leg and/or a waist strap may be attached to the back of the bag. In lieu also of the more costly plastic buckle/fastener members for the cover 44, Velcro fasteners may be used.

While the subject invention has been described with respect to its presently preferred embodiment and various modifications thereto, it is to be appreciated that still other embodiments and modifications may suggest themselves to those who have skill in the art. Accordingly, it is contemplated the following claims should be interpreted to include those all equivalent embodiments within the spirit and scope thereof.

What is claimed is:

1. A shoulder carried utility bag comprising:

(a) a fabric pouch having a closed bottom, surrounding sides and an open upper end which includes a topmost first closeable portion and a second adjoining open portion extending downward from the first portion to a point along the sides of said bag;

(b) a draw cord slidably mounted within a hem of said pouch extending about said first closeable portion for opening and closing said first open portion and such that as said first closeable portion is closed said second open portion is elevated and exposed to wearer access;

(c) a padded shoulder strap;

(d) buckle means for releasably securing said shoulder strap in length adjustable relation to said draw cord;

(e) a rigid arcuate member sewn to a back side of said bag for conformably protectively supporting said pouch about the hip and thigh of the wearer; and (f) a cover member hinge coupled to a back side of said bag and including means for conformably mounting said cover over said first and second portions and means for securing a front edge of said cover member to said bag.

2. Apparatus as set forth in claim 1 including a strap secured to the bottom of said bag and mountable about a wearer's leg.

3. Apparatus as set forth in claim 1 wherein the bag sides are pliant relative to a rigid kidney shaped bottom having an indented edge vertically aligning with said U-shaped member.

4. Apparatus as set forth in claim 1 including a plurality of grommets secured to the sides of said pouch.

5. Apparatus as set forth in claim 1 including a plurality of removable closure members mountable over said second opening portion.

6. Apparatus as set forth in claim 1 wherein said cover member includes first and second strap members separately extending from opposite sides of said cover and looped about said draw closure cord and wherein each of said strap members includes means for cinching the loop length of said strap members relative to said draw closure cord.

7. Apparatus as set forth in claim 1 including at least one pocket mounted to the outer surface of said pouch.

8. Apparatus as set forth in claim 1 wherein a back edge of said cover member includes a plurality of relatively rigid tabs and at least one intermediate elastic hinge member sewn to said bag and wherein right and left side edges of the cover member each include an elastic pleated portion.

9. A shoulder carried utility bag comprising:

(a) a fabric pouch having a closed relatively rigid bottom, surrounding pliant sides and an open upper end including a first closeable portion and a second adjoining open portion extending downward from the topmost first closeable portion to a point along the sides of said bag;

(b) a draw cord slidably mounted within a hem of said pouch extending about said first closeable portion for opening and closing said first open portion such that as said first open portion is closed said second open portion is elevated and exposed to wearer access;

(c) a padded shoulder strap;

(d) first and second mating buckle means for releasably securing said shoulder strap to said draw cord and said draw cord in length adjustable relation to said pouch;

(e) a rigid arcuate member sewn to a back side of said bag in vertical alignment with an arcuate indention formed in a back edge of the bottom for conformably protectively supporting said pouch about the hip and thigh of the wearer;

(f) a cover member including means for conformably securing said cover member over said first closeable and said second open portions having first and second strap members extending from opposite sides of said cover member and looped about said draw closure cord and means for cinching the length of said strap members; and (g) at least one pocket mounted to an outer surface of said bag.

10. A shoulder carried utility bag comprising:

(a) a fabric pouch having a closed relatively rigid bottom, surrounding pliant sides and an open upper end including a first closeable portion and a second adjoining open portion extending downward from the first closeable portion to a point along the sides of said bag;

(b) a draw cord slidably mounted within a hem of said pouch and extending about said first closeable portion for opening and closing said first portion such that as said first open portion is closed said second open portion is elevated and exposed to wearer access;

(c) a padded shoulder strap;

(d) mating buckle means releasably securing said shoulder strap to said draw cord and said draw cord in length adjustable relation to said pouch; and (e) a rigid arcuate member sewn to a back side of said bag in vertical alignment with an arcuate indention formed in a back edge of the bottom for conformably supporting said pouch in spaced relation to the hip and thigh of the wearer.

* * * * *